US009546848B1

(12) United States Patent
Burger, Sr. et al.

(10) Patent No.: US 9,546,848 B1
(45) Date of Patent: Jan. 17, 2017

(54) FIREARM MOUNTING AND ACTIVATION SYSTEM FOR A NON-LETHAL ELECTROSHOCK WEAPON

(71) Applicants: Danny Burger, Sr., Kansas City, MO (US); Brooke E. Burger, Kansas City, MO (US)

(72) Inventors: Danny Burger, Sr., Kansas City, MO (US); Brooke E. Burger, Kansas City, MO (US)

( * ) Notice: Subject to any disclaimer, the term of this patent is extended or adjusted under 35 U.S.C. 154(b) by 8 days.

(21) Appl. No.: 14/977,912

(22) Filed: Dec. 22, 2015

(51) Int. Cl.
*F41B 11/00* (2013.01)
*F41H 9/10* (2006.01)
*F41H 13/00* (2006.01)
*F41G 1/35* (2006.01)

(52) U.S. Cl.
CPC *F41H 9/10* (2013.01); *F41G 1/35* (2013.01); *F41H 13/0012* (2013.01)

(58) Field of Classification Search
CPC ..... F41C 23/16; F41H 13/0025; F41A 19/58; F41A 19/68; A01D 34/84
USPC ..... 42/1.08, 117; 102/502; 361/232
See application file for complete search history.

(56) References Cited

U.S. PATENT DOCUMENTS

D372,067 S 7/1996 Predazzer
6,142,058 A 11/2000 Mayville
6,532,947 B1 3/2003 Rosa
6,752,137 B2 * 6/2004 Brunette ..... F41B 11/55 124/73
7,409,912 B2 8/2008 Cerovic et al.
8,339,763 B2 12/2012 McNulty, Jr.
8,393,107 B2 * 3/2013 Brown ..... F41C 7/00 42/105
2005/0188593 A1 9/2005 Cerovic
2005/0188827 A1 * 9/2005 McNulty, Jr. ..... F41B 15/04 89/1.11
2006/0027127 A1 * 2/2006 Cerovic ..... F41H 13/0018 102/502
2009/0064558 A1 3/2009 Woroner
2011/0198471 A1 * 8/2011 Marquez ..... F41A 11/02 248/316.4
2012/0036990 A1 * 2/2012 Braun ..... F41B 11/52 89/37.01
2016/0061560 A1 * 3/2016 Saadon ..... F41G 11/003 42/72

FOREIGN PATENT DOCUMENTS

WO WO2006026308 A 12/2006

* cited by examiner

*Primary Examiner* — Michael David
(74) *Attorney, Agent, or Firm* — Kyle A. Fletcher, Esq.

(57) ABSTRACT

The firearm mounting and activation system for a non-lethal electroshock weapon is a mounting device system and operating system. The firearm mounting and activation system for a non-lethal electroshock weapon is designed to allow the simultaneous operation of a non-lethal weapon while simultaneously using a weapon. The firearm mounting and activation system for a non-lethal electroshock weapon comprises a first mounting device, a second mounting device, a first component, and a second component.

19 Claims, 6 Drawing Sheets

FIREARM MOUNTING AND ACTIVATION SYSTEM FOR A NON-LETHAL ELECTROSHOCK WEAPON

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of housing or mounting systems for electrical components, more specifically, a mounting apparatus that allows a non-lethal electroshock weapon to be mounted onto a foregrip of a barreled firearm.

SUMMARY OF INVENTION

The firearm mounting and activation system for a non-lethal electroshock weapon is a mounting device system and operating system. The mounting device system comprises a first mounting device and a second mounting device. The first mounting device is mounted near the trigger of a barreled firearm such as a tactical rifle or a shotgun. The second mounting device is designed to mount a non-lethal weapon, such as a Taser or pepper mounting device is positioned beneath the barrel of the weapon in a position where the user's non-shooting hand is located during proper use of the weapon. The operating system comprises a two component remote control system. The first component of the remote control system allows users to disable the safety associated with the non-lethal weapon with the trigger finger from the user's shooting hand. The second component of the remote control system is located at the second mounting device. A finger from the user's non-shooting hand can be used to operate the non-lethal weapon.

These together with additional objects, features and advantages of the firearm mounting and activation system for a non-lethal electroshock weapon will be readily apparent to those of ordinary skill in the art upon reading the following detailed description of the presently preferred, but nonetheless illustrative, embodiments when taken in conjunction with the accompanying drawings.

In this respect, before explaining the current embodiments of the firearm mounting and activation system for a non-lethal electroshock weapon in detail, it is to be understood that the firearm mounting and activation system for a non-lethal electroshock weapon is not limited in its applications to the details of construction and arrangements of the components set skilled in the art will appreciate that the concept of this disclosure may be readily utilized as a basis for the design of other structures, methods, and systems for carrying out the several purposes of the firearm mounting and activation system for a non-lethal electroshock weapon.

It is therefore important that the claims be regarded as including such equivalent construction insofar as they do not depart from the spirit and scope of the firearm mounting and activation system for a non-lethal electroshock weapon. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 1 is a perspective view of an embodiment of the

DETAILED DESCRIPTION OF THE EMBODIMENT

Figure 1:
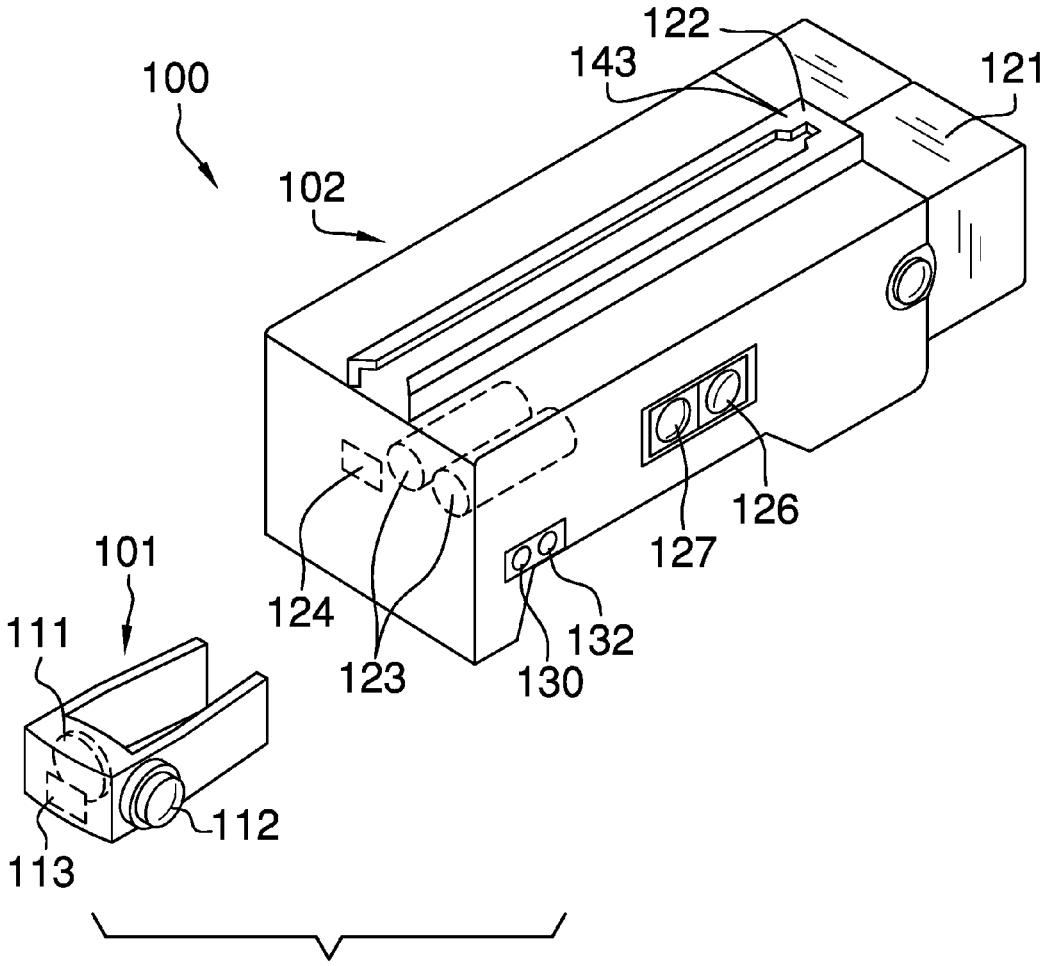
Figure 2:
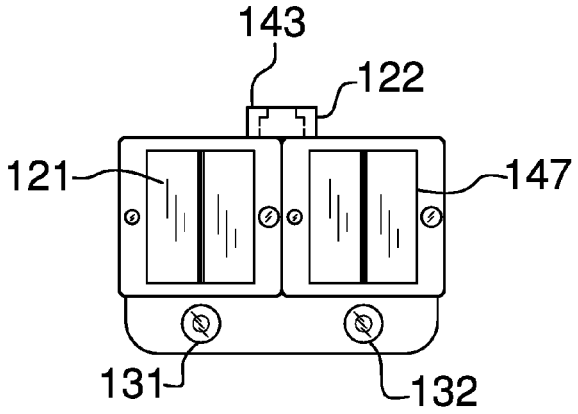
FIG. 2 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not there is no intention to be bound by any expressed or implied theory presented in the preceding technical field, background, brief summary or the following detailed description.

Detailed reference will now be made to multiple potential embodiments of the disclosure, which is illustrated in FIGS. 1 through 7.

The firearm mounting and activation system for a non-lethal electroshock weapon 100 (hereinafter invention) comprises a first mounting device 101, a second mounting device 102, a first component 103, and a second component 104. The invention 100 is intended to be mounted on a tactical weapon 141 used by law enforcement officials. Such weapons 141 include, but are not limited to, rifles 142 or shotguns 144.

The first mounting device 101 houses the first component 103. The first mounting device 101 is mounted on the weapon 141 on or near the trigger 146 guard 149. The first mounting device 101 is positioned such it can be reached by the trigger finger of the firing hand 152 without having to move the firing hand 152 from its proper position on the weapon 141. The firing hand 152 is the hand of the user 151 that is used to operate the trigger 146 of the weapon 141. The other hand of the user 151 is referred to as the non-firing hand 153

Figure 7:
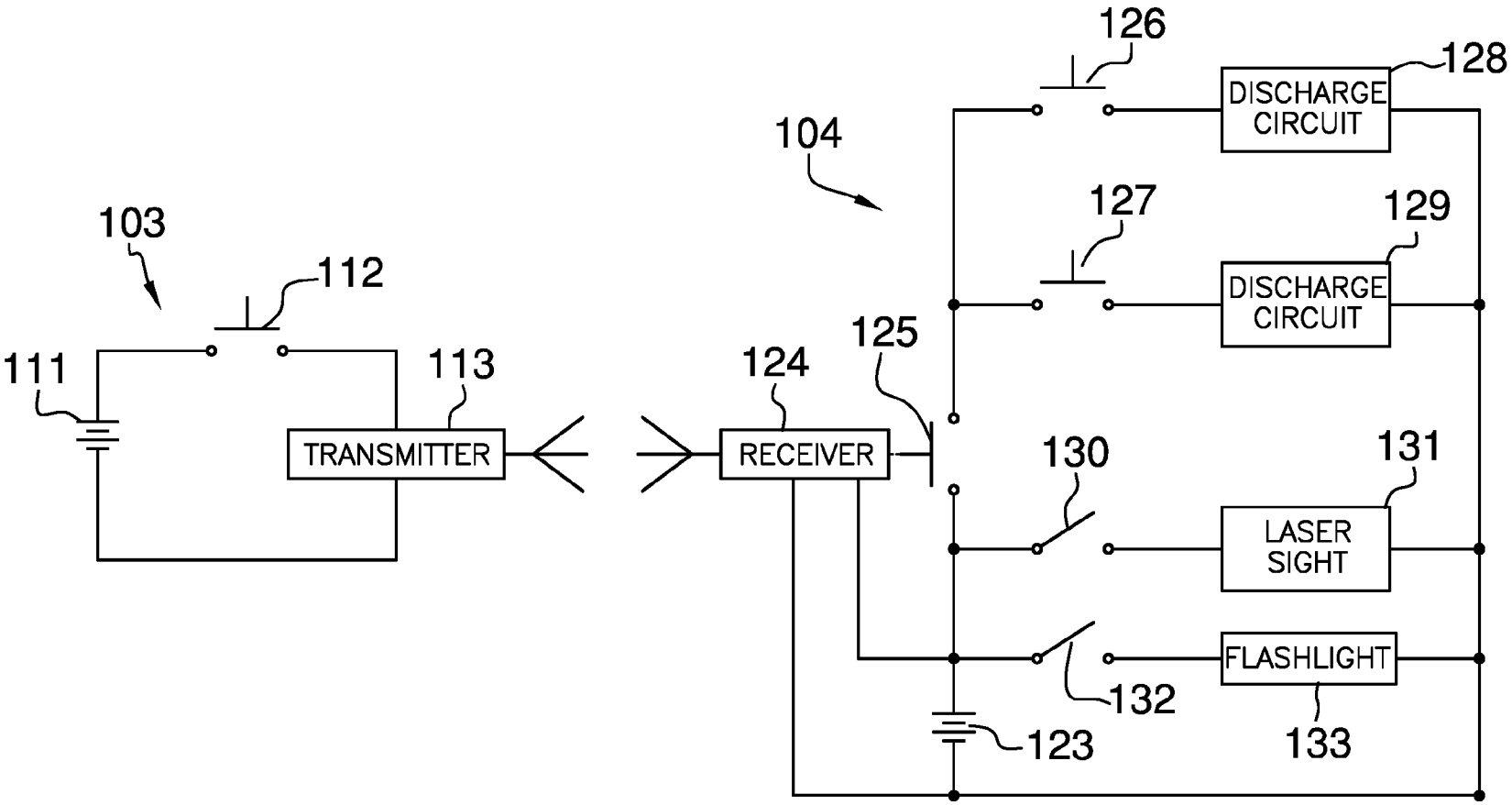
FIG. 7 is a schematic view of an embodiment of the disclosure.

As shown in FIG. 7, the first component 103 further transmitter 113. The first battery 111 is used to provide the energy required to operate the transmitter 113. The safety switch 112 is a normally open momentary switch that is used to complete the circuit between the first battery 111 and the transmitter 113. The safety switch 112 is mounted with the first component 103 such that the safety switch 112 is accessible to the trigger finger of the user 151. When the safety switch 112 is closed, the transmitter 113 transmits a signal to the second component 104 that enables the discharge of a non-lethal weapon 121 that is contained in the second mounting device 102. When the safety switch 112 is opened, the transmitter 113 no longer transmits a signal to the second component 104 which then disables the discharge of the non-lethal weapon 121 that is contained in the second mounting device 102. The second mounting device 102 and the second component 104 are discussed in more detail elsewhere in this disclosure.

The second mounting device 102 comprises a non-lethal weapon 121, a gun mount 122, and the second component 104. The non-lethal weapon 121 is a non-lethal self-defense device that is attached to the weapon 141 through the gun mount 122. Non-lethal weapons 121 include, but are not limited to, Taser devices and a device designed to discharge oleoresin capsicum, designed to discharge oleoresin capsicum are commercially available. The non-lethal weapon 121 is attached to the gun mount 122. The purpose of the gun mount 122 is to attach the second mounting device 102 to the weapon 141. Appropriate gun mounts include 122, but are not limited to, a rifle 142 mount 143 and a pump mount 145. The rifle 142 mount 143 is a track that is designed to fit onto a rail that is commonly found on rifles 142 used as tactical weapons 141 by law enforcement officials. The pump mount 145 is a track that is designed to replace the pump bar of a shotgun 144. The non-lethal weapon 121 is also attached to the second component 104, which is used to operate the non-lethal weapon 121.

The second component 104 is a housing that, as shown if FIG. 7, further comprises and contains a second battery 123, a receiver 124, an enable switch 125, a first discharge switch 126, a second discharge switch 127, a first discharge circuit 128, a second discharge circuit 129, a laser switch 130, a laser sight 131, a flashlight switch 132, and a flashlight 133. The second battery 123 is used to provide the energy to operate the receiver 124, first discharge circuit 128, the second discharge circuit 129, the laser sight 131 and the flashlight 133.

The receiver 124 is an electrical circuit that receives the signal transmitted from the transmitter 113 of the first receiver 124 is receiving a signal from the transmitter 113, the receiver 124 keeps the enable switch 125 closed. Once the signal from the transmitter 113 is discontinued, the receiver 124 opens the enable switch 125. The enable switch 125 is used to control electricity flow from the second battery 123 to the first discharge switch 126, the first discharge circuit 128, the second discharge switch 127 and the second discharge circuit 129.

When the enable switch 125 is open, the electrical energy required to operate the first discharge circuit 128 and the second discharge circuit 129 is interrupted effectively making the first discharge circuit 128 and the second discharge circuit 129 inoperable.

When the enable switch 125 is closed, the operation of the first discharge circuit 128 and the second discharge circuit 129 are controlled by the first discharge switch 126 and the second discharge switch 127 respectively. Specifically, when both the enable switch 125 and the first discharge switch 126 are simultaneously closed, the first discharge circuit 128 is activated which activates the non-lethal weapon 121.

When both the enable switch 125 and the second discharge switch 127 are simultaneously closed, the second discharge circuit 129 is activated. When the selected non-lethal weapon with pepper spray units 148; then the second discharge switch 127 and the second discharge circuit 129 can be removed or disabled. The first discharge switch 126 and the second discharge switch 127 are mounted within the housing of the second component 104 such that the first discharge switch 126 and the second discharge switch 127 are can be reached by the non-firing hand 153 without having to move the non-firing hand 153 from its proper position on the weapon 141.

The second component 104 further comprises a laser sight 131 and a laser switch 130. The laser sight 131 is a device comprising an optical system that generates a reticle for use in targeting the weapon 141. The laser sight 131 is built into the housing of the second component 104 such that the reticle can be projected from the second component 104. As shown in FIG. 7, the laser sight 131 is controlled by a laser switch 130 which is used to control the flow of electrical energy to the laser sight 131.

The laser switch 130 is automatically activated when the enable switch 125 is closed. Moreover, the laser switch 130 is located on the housing of the second component 104 such that it is accessible by the user 151. The second component 104 further comprises a flashlight 133 and a flashlight switch 132. The flashlight 133 is an electrically powered lamp that is used to flashlight 133 is built into the housing of the second component 104 such that light can be projected from the second component 104. As shown in FIG. 7, the flashlight 133 is controlled by a flashlight switch 132, which is used to control the flow of electrical energy to the flashlight 133. The flashlight switch 132 is located on the housing of the second component 104 such that it is automatically activated when the enable switch 135 is closed.

A readily and commercially available remote control system can be used as the first component 103 and the receiver 124 and enable switch 125 of the invention 100. The batteries and remaining switches discussed in this disclosure are commercially available. The non-lethal weapons 121 discussed in this disclosure are commercially available. The circuits to perform the functions of the receiver 124, first discharge circuit 128, and second discharge circuit 129 are well known and readily synthesized by those skilled in the electrical arts. The laser sight 131 and the flashlight 133 are commercially available. A red dot sight can be substituted for the laser sight 131. Tracks for rifle 142 rails and shotgun 144 pumps are commercially available.

Figure 4:
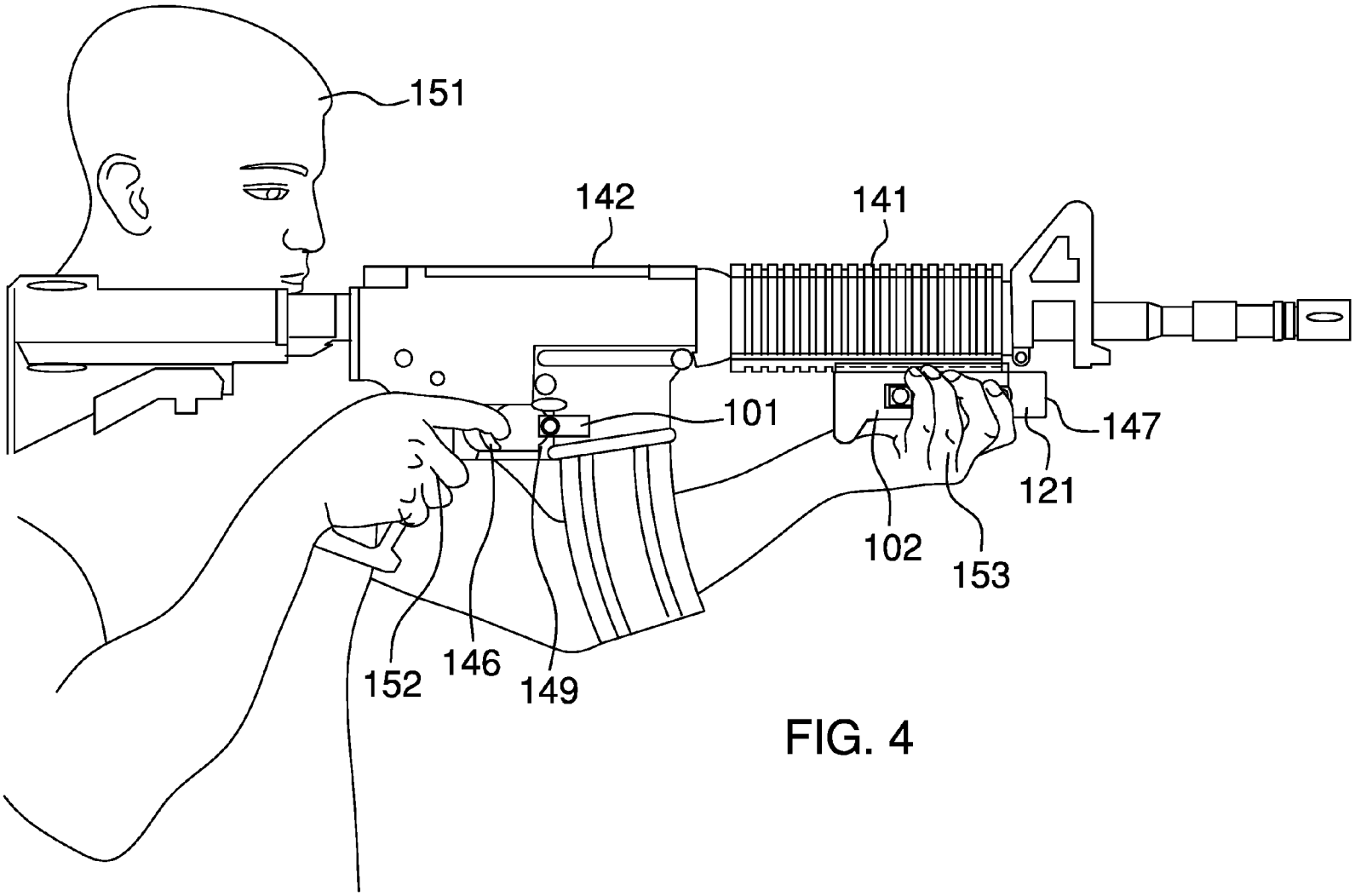
FIG. 4 is an in use view of an embodiment of the disclosure.

In the first potential embodiment of the disclosure, as shown in FIGS. 1 and 4, a rifle 142 mount 143 and a Taser unit 147 with two power cartridges is used.

Figure 3:
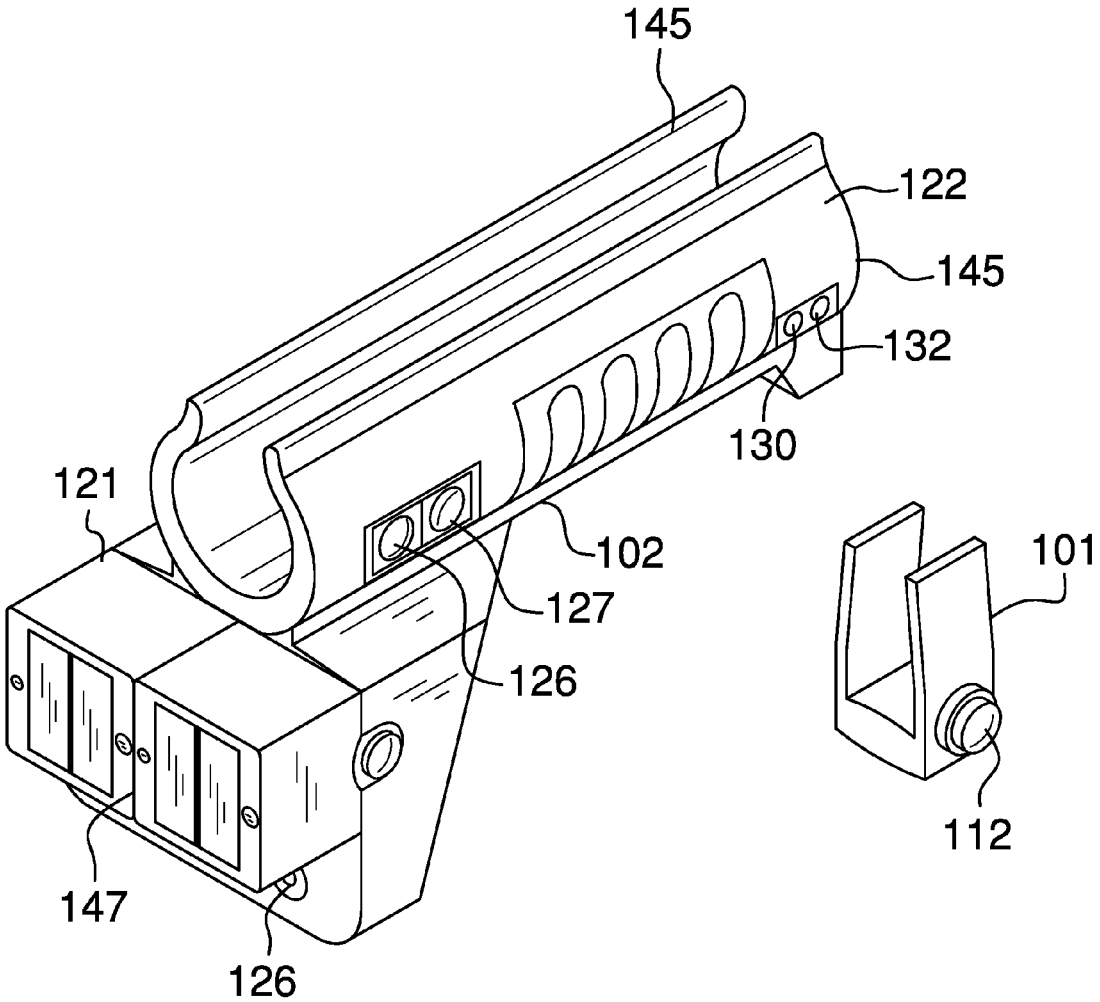
FIG. 3 is a perspective view of an alternative embodiment of the disclosure.
Figure 5:
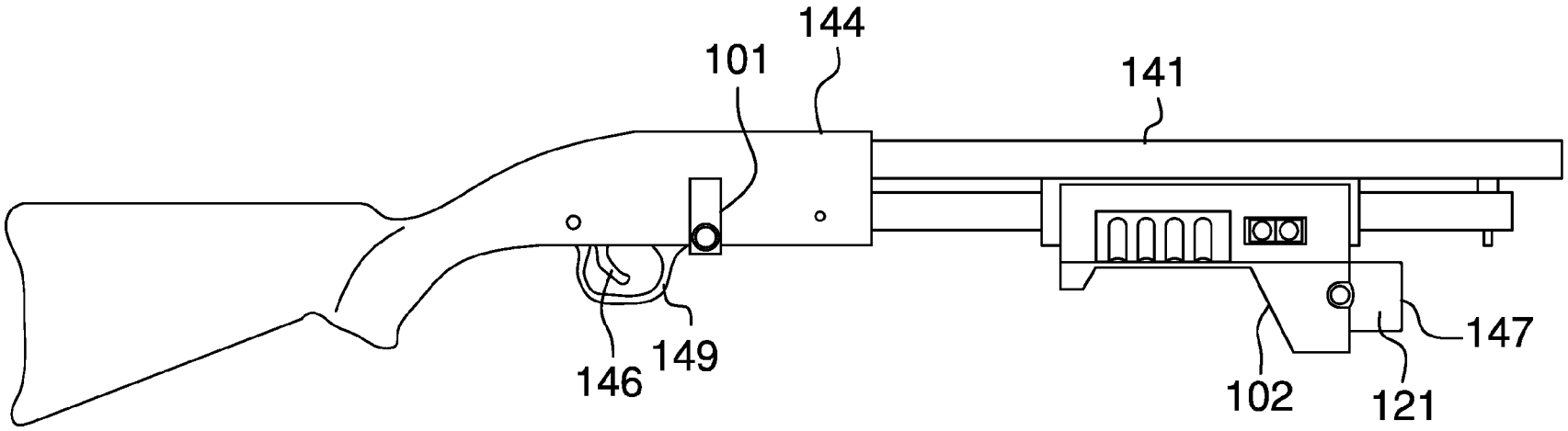
FIG. 5 is an in use view of an embodiment of the disclosure.
Figure 6:
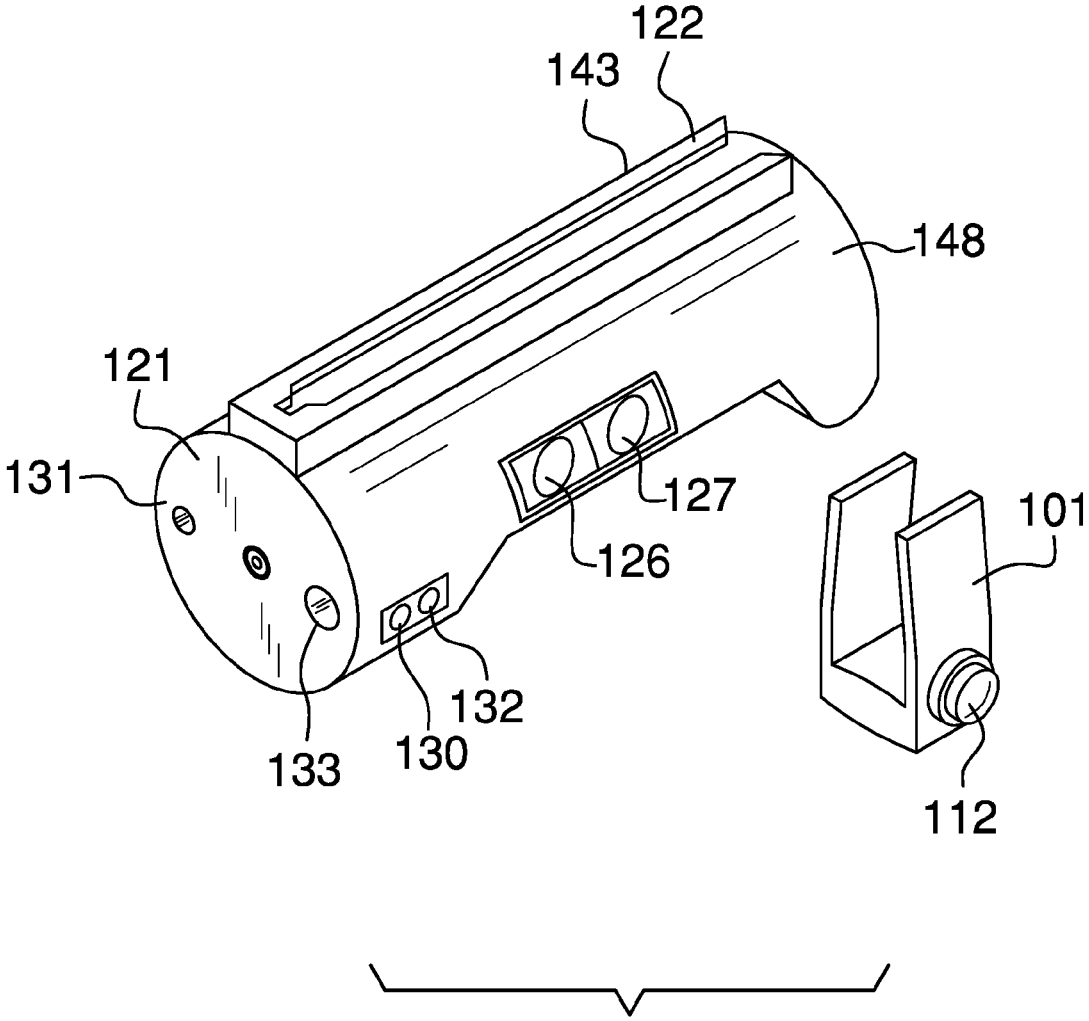
FIG. 6 is a perspective view of an alternative embodiment of the disclosure.

In a second potential embodiment of the disclosure, as shown in FIGS. 3 and 5, a pump mount 145 and a Taser unit 142 with two power cartridges is used.

In a third potential embodiment of the disclosure, as shown in FIG. 5, a rifle 142 mount 143 and at least one discharge pepper spray unit 148 is used. The second discharge switch 127 and the second discharge circuit 129 were included in the second component 104 but are disabled.

The following definitions were used in this disclosure:

Battery: As used in this disclosure, a battery is a container consisting of one or more cells, in which chemical energy converted into electricity and used as a source of power.

Housing: As used in this disclosure, a housing is a rigid casing that encloses and protects one or more devices.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A mounting and activation system configured for use with non-lethal weapons comprising: a first mounting device and a second mounting device; wherein the mounting and activation system for non-lethal weapons is configured for use with a tactical weapon;

wherein the first mounting device houses a first component; wherein the second mounting device houses a second component;

wherein the first mounting device is mounted on the tactical weapon such that the first mounting device can be reached by the firing hand of a user without having to move the firing hand from its proper position on the tactical weapon;

wherein the second mounting device is mounted on the tactical weapon such that the second mounting device can be reached by the non-firing hand of a user without having to move the non-firing hand from its proper position on the tactical weapon;

wherein the first component further comprises a safety switch that enables and disables the operation of the non-lethal weapon;

wherein the second component is designed to operate the non-lethal weapon.

2. The mounting and activation system for non-lethal weapons according to claim 1 wherein the safety switch is a first normally open momentary switch.

3. The mounting and activation system for non-lethal weapons according to claim 2 wherein the first component further comprises a transmitter;

wherein the safety switch operates the transmitter.

4. The mounting and activation system for non-lethal weapons according to claim 3 wherein the transmitter sends a signal to the second component that enables the discharge of the non-lethal weapon.

5. The mounting and activation system for non-lethal weapons according to claim 4 wherein the second mounting device further comprises a non-lethal weapon.

6. The mounting and activation system for non-lethal weapons according to claim 5 wherein the non-lethal weapon is a non-lethal self-defense device selected from the group consisting of Taser devices or a device designed to discharge oleoresin capsicum.

7. The mounting and activation system for non-lethal weapons according to claim 6 wherein the non-lethal weapon further comprises a gun mount;

wherein the gun mount attaches the second mounting device to the tactical weapon.

8. The mounting and activation system for non-lethal weapons according to claim 7 wherein the second component further comprises and contains a receiver, an enable switch, a first discharge switch, a first discharge circuit.

9. The mounting and activation system for non-lethal weapons according to claim 8 wherein the receiver further comprises an electrical circuit that receives the signal transmitted from the transmitter of the first component and closes the enable switch.

10. The mounting and activation system for non-lethal weapons according to claim 9 wherein the enable switch further comprises a second normally open momentary switch that enables the flow of electricity to the first discharge switch and the first discharge circuit.

11. The mounting and activation system for non-lethal weapons according to claim 10 wherein the first discharge switch further comprises a third normally open momentary switch that enables the flow of electricity to first discharge circuit.

12. The mounting and activation system for non-lethal weapons according to claim 11 wherein the first discharge circuit further comprises an electrical circuit that generates an electrical signal that discharges the non-lethal weapon.

13. The mounting and activation system for non-lethal weapons according to claim 12 wherein the second component further comprises a laser switch and a laser sight.

14. The mounting and activation system for non-lethal weapons according to claim 12 wherein the second component further comprises a flashlight switch and a flashlight.

15. The mounting and activation system for non-lethal weapons according to claim 12 wherein the second component further comprises and contains a second discharge switch and a second discharge circuit.

16. The mounting and activation system for non-lethal weapons according to claim 15 wherein the enable switch is placed in series with the second discharge switch and the second discharge circuit.

17. The mounting and activation system for non-lethal weapons according to claim 16 wherein the second discharge switch further comprises a fourth normally open momentary switch that enables the flow of electricity to second discharge circuit.

18. The mounting and activation system for non-lethal weapons according to claim 17 wherein the second discharge circuit further comprises an electrical circuit that generates an electrical signal that discharges the non-lethal weapon.

19. The mounting and activation system for non-lethal weapons according to claim 18 wherein the second component further comprises a laser switch and a laser sight;

wherein the laser switch automatically illuminates upon activation of the enable switch;

wherein the second component further comprises a flashlight switch and a flashlight;

wherein the flashlight switch automatically illuminates upon activation of the enable switch.

* * * * *